United States Patent [19]

Lugscheider et al.

[11] Patent Number: 4,617,671

[45] Date of Patent: Oct. 14, 1986

[54] ARRANGEMENT FOR PRODUCING METALS, SUCH AS MOLTEN PIG IRON, STEEL PRE-MATERIAL AND FERROALLOYS

[75] Inventors: Walter Lugscheider, Linz; Paul Müllner; Wilhelm Schiffer, both of Traun; Alois Leutgöb, Steyr, all of Austria

[73] Assignee: Voest-Alpine Aktiengesellschaft, Linz, Austria

[21] Appl. No.: 696,357

[22] Filed: Jan. 30, 1985

Related U.S. Application Data

[62] Division of Ser. No. 558,034, Dec. 5, 1983, Pat. No. 4,533,385.

[30] Foreign Application Priority Data

Dec. 7, 1982 [AT] Austria ..... 4445/82

[51] Int. Cl.[4] ..... H05B 7/00

[52] U.S. Cl. ..... 373/22

[58] Field of Search ..... 373/18–25, 373/82; 75/10 R, 11, 12; 266/225, 226

[56] References Cited

U.S. PATENT DOCUMENTS

| | | | |
|---|---|---|---|
| 3,404,078 | 10/1968 | Goldberger | 373/22 X |
| 3,472,650 | 10/1969 | Sibakin et al. . | |
| 3,708,599 | 1/1973 | Krause . | |
| 3,736,358 | 5/1973 | DeCorso et al. . | |
| 3,843,351 | 10/1974 | Smith et al. . | |
| 3,936,586 | 2/1976 | Tylko . | |
| 4,203,760 | 5/1980 | Rossner et al. . | |
| 4,426,709 | 1/1984 | Fegerl et al. | 373/22 |

FOREIGN PATENT DOCUMENTS

| | | |
|---|---|---|
| 257964 | of 0000 | Austria . |
| 2733790 | of 0000 | Fed. Rep. of Germany . |
| 1458797 | of 0000 | Fed. Rep. of Germany . |
| 1545464 | of 0000 | France . |
| 2085480 | of 0000 | United Kingdom . |

*Primary Examiner*—Roy N. Envall, Jr.

*Attorney, Agent, or Firm*—Brumbaugh, Graves, Donohue & Raymond

[57] ABSTRACT

With a method for producing metals, the raw material is melted in a metallurgical vessel by at least one plasma burner directed from top to bottom. In order to be able to protect the furnace brickwork from too strong a thermal load exerted by the plasma jet, and to make available the energy supplied by the plasma burner to melting and reducing the fine ore to as large an extent as possible as well as to prevent an agglomeration of the raw material to be used, the raw material is topcharged into the metallurgical vessel in the form of fine particles directed parallel to the plasma jet so as to peripherally surround the same. Oxygen-containing gases and carbon are bottom-blown into the vessel through the melt. A foamed slag is formed in the vessel, surrounding the plasma jet over its total height and the flow of supplied raw material particles peripherally. In an arrangement for carrying out the method the plasma burner is peripherally surrounded by a jacket so as to form a supply space for the fine raw material particles which surrounds the plasma burner peripherally. Nozzles are provided in the bottom of the metallurgical vessel to supply oxygen-containing gas and carbon.

3 Claims, 3 Drawing Figures

FIG. 2A
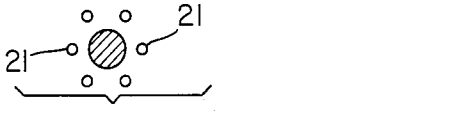
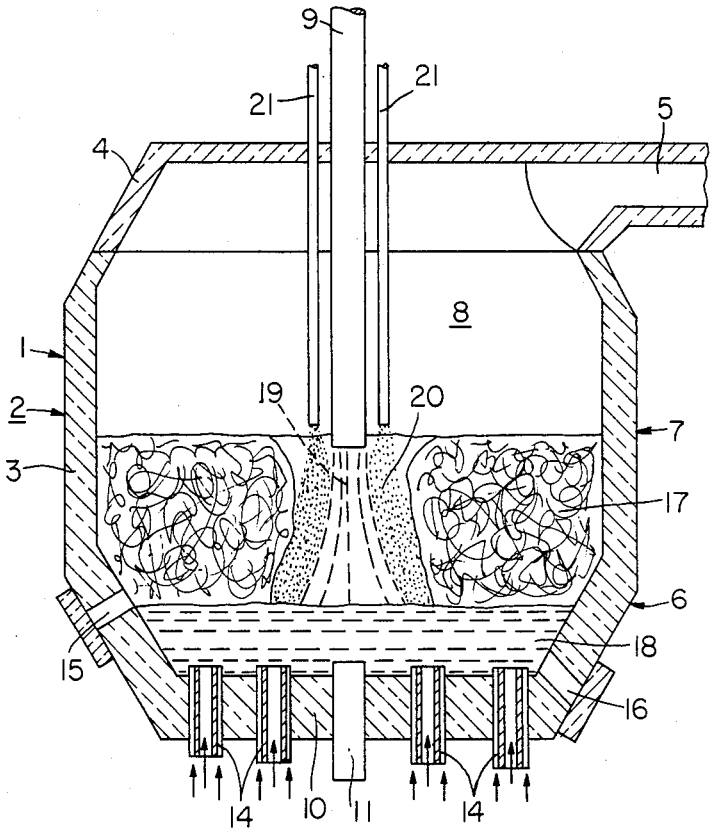
FIG. 2

ARRANGEMENT FOR PRODUCING METALS, SUCH AS MOLTEN PIG IRON, STEEL PRE-MATERIAL AND FERROALLOYS

This application is a division of application Ser. No. 558,034, filed on Dec. 5, 1983, now U.S. Pat. No. 4,533,385.

BACKGROUND OF THE INVENTION

The invention relates to a method for producing metals, in particular molten pig iron, steel pre-material or ferroalloys, from metal-oxide-containing raw material, the raw material being melted in a metallurgical vessel by means of at least one plasma burner directed from top to bottom, as well as to an arrangement for carrying out the method.

The processing of fine ores to liquid metal, with the reduction aggregates presently in use, requires preagglomeration. If, for instance, fine-grained iron ores are to be reduced and melted to liquid metal, which usually takes place in a blast furnace or in an electric reduction furnace, it is necessary, in order to achieve a yield as economical as possible and a good reduction performance with as low a fuel consumption as possible, to make the ore lumpy by sintering, pelletizing or briquetting.

This also holds for the production of ferroalloys (FeCr, FeMn, FeW, FeNi, FeSi, . . . ), which are melted primarily in electric reduction furnaces.

The disadvantages of these known methods are to be seen, among others, in the high technological and economic expenditures required for the treatment of the ores prior to the melting and reduction processes proper, and in the relatively long process time.

From Austrian Pat. No. 257,964, a method of the initially defined kind for the reduction of metallic oxides by means of an electric arc plasma is known. The plasma arc is struck between a plasma burner vertically arranged in the lid and a bottom electrode arranged in the bottom of a melting vessel.

The reduction of the metal oxides takes place in the slag layer by subjecting the molten oxide to the electric arc plasma jet containing a hydrocarbon gas, and by reducing this molten oxide by the decomposition products of the hydrocarbon gas.

This known method has the disadvantage that the thermal energy radiated off the plasma jet constitutes a great load on the furnace lining, since the strongest heat radiation occurs perpendicularly to the axis of the plasma jet. This involves a shorter furnace campaign, i.e., the operation time of the furnace from one bricking up to the next bricking up of the refractory lining, on the one hand, and a poor utilization of the energy supplied on the other hand, since a large part of the heat must be absorbed by the furnace brickwork without participating in the melting process.

SUMMARY OF THE INVENTION

The invention has as its object to provide a method, as well as an arrangement for carrying out the method, which makes it possible to produce both pig iron and liquid metals similar to pig iron as well as ferroalloys, while not only protecting the furnace brickwork from too strong a thermal load exerted by the plasma jet, but also making available the energy supplied by the plasma burner to melting and reducing the fine ore to as large an extent as possible.

Furthermore, a pre-agglomeration of the raw material to be used, i.e., of the fine ore to be used, is to be avoided so that the expenditures connected therewith will be eliminated.

This object is achieved according to the invention by a combination of the following characteristic features:

the raw material is topcharged into the metallurgical vessel in the form of fine particles directed parallel to the plasma jet so as to peripherally surround the same, oxygen-containing gases and carbon are bottom-blown into the vessel through the melt, and a foamed slag is formed in the vessel, surrounding the plasma jet over its total height and the flow of supplied raw material particles peripherally.

The foamed slag creates an effective protection of the furnace brickwork against the heat radiation coming from the plasma jet. The sheathing of the plasma jet by the fine raw material particles used allows for an optimum utilization of the heat radiation of the plasma jet. The blowing in of carbon through the bottom leads to preventing the escape of carbon. By the supply of the oxygen-containing gas through the bottom, a premature destruction of the cathode by oxygen is prevented.

According to a preferred embodiment, the supply of raw material particles is stopped after melting of the same, with merely oxygen-containing gas and/or carbon being blown in from the bottom through the melt.

An arrangement for carrying out the method according to the invention comprises a refractorily lined metallurgical vessel and a plasma burner directed from top to bottom, with a counter electrode being arranged in the bottom of the vessel, and is characterized in that the plasma burner is peripherally surrounded by a jacket so as to form a supply space for the fine raw material particles which surrounds the plasma burner peripherally, and that nozzles, preferably jacket nozzles, are provided in the bottom of the metallurgical vessel to supply oxygen-containing gas and carbon.

BRIEF DESCRIPTION OF THE DRAWINGS

The invention will now be explained in more detail by way of one embodiment and with reference to the drawing, in which

FIG. 2 illustrates a modification of the vessel shown in FIG. 1 in which lances are provided for introducing raw material particles into the vessel around the plasma burner; and FIG. 2A is a partial top view of FIG. 2 showing the plasma burner surrounded by the lances.

Referring now to FIG. 1, the metallic outer jacket 1 of a metallurgical vessel 2 is provided with a refractory lining 3. The vessel 2 is closed by a lid 4, which is also refractorily lined. To the lid 4 an offgas duct 5 is connected. The vessel lower part 6 upwardly is followed by a substantially vertical cylindrical vessel part 7. A vertical plasma burner 9 centrally arranged within the vessel 2 projects through the lid 4 of the vessel 2 into its interior 8. In the bottom 10 of the vessel 2 a bottom electrode 11 for the plasma burner 9 also is centrally inserted.

Figure 1:
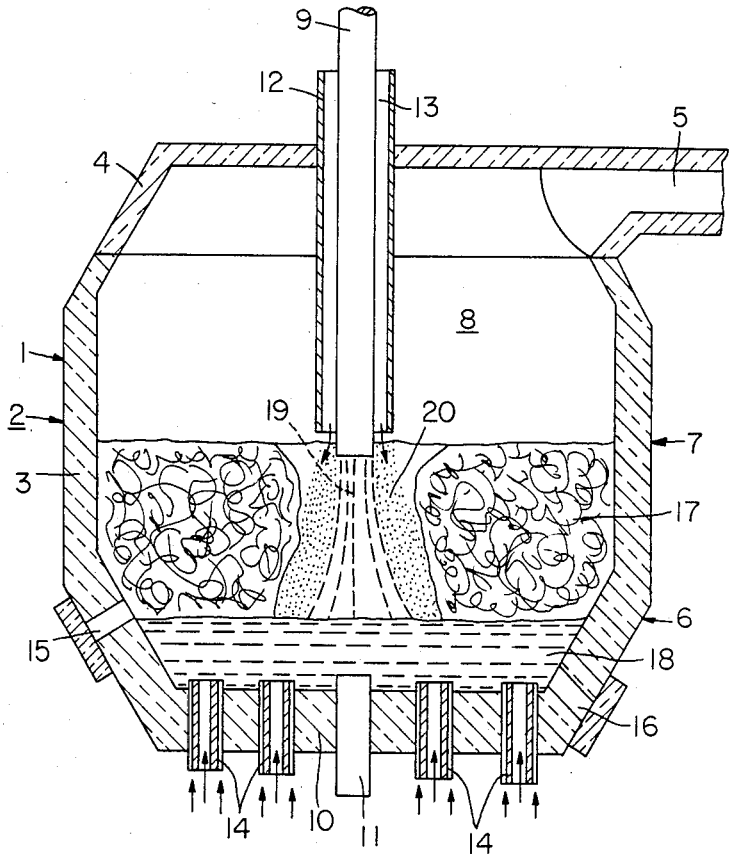
FIG. 1 illustrates schematically in vertical section a metallurgical vessel constructed according to the invention.

The plasma burner 9 is peripherally surrounded by a jacket 12 so as to form an annular space 13 surrounding the plasma burner 9 and open towards the vessel bottom 10. Alternatively, several top blowing lances 21, peripherally surrounding the plasma burner, may be provided for introducing the raw material particles, as shown in FIGS. 2 and 2A. In the bottom 10 of the vessel 2 bottom nozzles 14, preferably designed as jacket nozzles of the kind disclosed in U.S. Pat. No. 4,426,709, are arranged, through which oxygen and/or carbon is blown into the interior 8 of the vessel 2.

In the vessel lower part 6, a slag tap hole 15 and a metal tap hole 16 are provided. The slag present in the vessel is denoted by 17, the molten metal is denoted by 18, and the plasma jet is denoted by 19. The raw material sheath surrounding the plasma jet bears the reference numeral 20.

In the following, the function of the above-described arrangement during the production of pig iron will be explained in more detail:

A first charging with fine ore and slag formers is effected via the annular space 13 (or the top blowing lances optionally provided instead). After this, a plasma arc 19 is struck between the plasma burner 9 movable in the vertical direction (for the optimum adjustment of the length of the plasma arc) and the water-cooled bottom electrode 11, and the charge, if desired mixed with fine-particle coal, is melted by the heat radiated off the plasma arc 19 and is reduced by means of the reduction gas blown in together therewith.

After the formation of a metal sump 18 and a slag layer 17, oxygen and/or carbon is jetted in both from top through the annular space 13 (or the top blowing lances), in addition to the charge and the reduction gas, and from the bottom through the bottom nozzles, in order to build up a foamed slag.

A foaming of the slag is possible only if a sufficient FeO-content and carbon content in the form of elementary carbon or carbon-saturated metal splashes are present in the slag. In this case, the carbon and the oxygen of the iron oxide react by forming carbon monoxide. This gas formation leads to a swelling or foaming of the slag. Moreover, a sufficient slag height and an appropriate slag viscosity are required for the foaming of the slag.

Thus, the carbon serves for reduction, heating (by burning with oxygen) and foaming.

As the melting phase is over, the supply of fine ores is stopped, yet oxygen and/or carbon continue to be nozzled in through the bottom nozzles 14. In the subsequent finishing reduction phase the process is conducted in a manner that the desired tapping temperature on the one hand and a low metal oxide content on account of a relatively high excess of carbon in the slag 17 on the other hand will be achieved. Subsequently, it is slagged off through the slag tap hole 15 and tapped off through the metal tap hole 16.

With the method according to the invention, a difference is made between a melting phase and a finishing reduction phase. Accordingly, also the slag compositions vary. In the following, recommended data of the slag analysis for the melting and finishing melting phases during the production of liquid metal similar to pig iron with about 2% carbon in a basic-lined reduction reactor are indicated.

Slag composition in the melting phase:

30 to 35% $FeO+FE_3O_4$; 40 to 45% $CaO+MnO$; 15 to 20% $SiO_2$; Balance $P_2O_5$, $Al_2O_3$, MgO, i.a.

Slag composition in the finishing melting phase:

10 to 15% total iron content of the slag (the iron being bound to the oxygen largely in the form of FeO); 50 to 55% $CaO+MnO$; 20 to 25% $SiO_2$; Balance $P_2O_5$, $Al_2O_3$, MgO, i.a.

In addition to supplying electric energy through the plasma burner 9, a large part of the required energy is supplied in the form of carbon and oxygen (carbon burns with oxygen, thus releasing energy), whereby it is possible to produce at favorable costs also high-melting alloys, in particular high-melting ferroalloys. The basic considerations pointed out above with respect to the formation of slag also hold for the production of ferroalloys. However, in this case the iron oxide content decreases, while the contents of Mn, Cr, W oxides a.o., increase.

The high temperature produced by the plasma burner 9 is particularly advantageous mainly in the melting phase. For as economical a furnace operation as possible it is suitable if a metal sump 18 remains in the melting vessel 2 after tapping; at a new charging, the blowing in of carbon and/or oxygen (both from the bottom and from top)—as an additional energy supply to the plasma burner 9—may be started at once.

In addition to the advantages of an optimum utilization of the energy supplied by the plasma jet 19 and the fact that the furnace lining is spared to a large extent, the method according to the invention also offers the chance of keeping the amounts of offgases as low as possible by a clear-cut process conduct (by an appropriate energy supply by the plasma burner 9 as well as a dosed blowing in of heating, reduction and foaming gases). The hot offgases suitably can be used to preheat and/or partially pre-reduce the ore used.

What we claim is:

1. In an arrangement for producing metals, such as molten pig iron, steel pre-material and ferroalloys, of metal-oxide-containing raw material by melting said raw material and of the type including a refractorily lined metallurgical vessel having a vessel bottom and accommodating said raw material, a plasma burner directed from top to bottom and forming a plasma jet for melting said raw material, and a counter electrode arranged in said vessel bottom, the improvement which comprises a jacket peripherally surrounding said plasma burner so as to form a supply space peripherally surrounding said plasma burner and adapted to top-charge said raw material having fine-particle form into said metallurgical vessel in a flow parallel to said plasma jet so as to surround it peripherally, and nozzles provided in said vessel bottom to supply oxygen-containing gas and carbon into said metallurgical vessel so as to form foamed slag surrounding said plasma jet over its total height and peripherally surrounding said flow of fine-particle raw material.

2. An arrangement as set forth in claim 1, wherein said nozzles are designed as jacket nozzles.

3. An arrangement as set forth in claim 1, wherein said supply space is formed by a plurality of top-blowing lances peripherally surrounding said plasma burner.

* * * * *